United States Patent [19]

Provence et al.

[11] Patent Number: 5,004,262

[45] Date of Patent: Apr. 2, 1991

[54] FRONT BINDING FOR CROSS-COUNTRY SKI BOOT

[75] Inventors: Marc Provence, Thorens les Glieres; Gerard Graillat, Annecy, both of France

[73] Assignee: Salomon S. A., Chavanod, France

[21] Appl. No.: 433,094

[22] Filed: Nov. 8, 1989

[30] Foreign Application Priority Data

Nov. 8, 1988 [FR] France ..... 88 14551

[51] Int. Cl.[5] ..... A63C 9/00

[52] U.S. Cl. ..... 280/615; 280/634

[58] Field of Search ..... 280/615, 626, 627, 631, 280/632, 634, 636

[56] References Cited

U.S. PATENT DOCUMENTS 4,322,091 3/1982 Storandt ..... 280/615
4,743,042 5/1988 Jarvinen ..... 280/631

FOREIGN PATENT DOCUMENTS 3924915 2/1990 Fed. Rep. of Germany .
2634132 1/1990 France .
451774 5/1968 Switzerland ..... 280/631

*Primary Examiner*—Charles A. Marmor
*Assistant Examiner*—Eric Culbreth
*Attorney, Agent, or Firm*—Pollock, Vande Sande & Priddy

[57] ABSTRACT

A front binding for a cross-country ski boot (3), in which a sliding piece (13) of synthetic material is inserted between a locking slide (6) and a fixed slide (9), on its face subjected to friction resulting from relative movement between the locking slide (6) and the slide (9), the sliding piece (13) has transverse projections (14) of relatively flexible material which are deformed so as to always be applied with a certain pressure against the surface on which they slide plastically or elastically when the locking slide (6) moves longitudinally.

8 Claims, 1 Drawing Sheet

FRONT BINDING FOR CROSS-COUNTRY SKI BOOT

FIELD OF THE INVENTION

The present invention relates to a front binding for a cross-country ski boot.

BACKGROUND OF THE INVENTION

It is already known to provide front bindings for cross-country ski boots which comprise a longitudinally movable locking slide, controlled by an operating lever articulated on the casing of the binding, in a sliding surface fixed to the ski. This slide comprises, at its front end, a hook extending transversely, which is solid with of an inner core extending it towards the back and which extends horizontally above a base plate fixed to the upper face of the ski. This inner core is slidingly engaged in a longitudinal sliding surface which is fixed to the upper face of the ski. Moreover, the binding comprises a frontal abutment extending transversely and located behind the casing of the binding. This abutment extends with respect to the hook of the locking slide with which it cooperates to retain in a locking position, between itself and the hook of the slide, a transversal hooking axle at the front part of the sole of the boot. In unlocked position, the locking slide is so positioned such that the hook of the slide is separated from the frontal abutment. The front of the boot can then be hooked to the binding in engaging the transversal axle solid with the front end of the sole in the space between the hook and the frontal abutment, this engagement occurring from top to bottom in the direction of the upper surface of the ski. To latch the binding, it then suffices to move the operating lever of the binding in such a way as to displace the locking slide and its hook, until it comes into immediate proximity with the frontal abutment. At this point, the hooks tightens the hooking axle of the boot and retains it between itself and the frontal abutment.

Generally, the movable locking slide and the longitudinal sliding surface in which the slide is displaced, are constituted by metal pieces having a high coefficient of friction, and producing, in certain cases, rather significant resistance opposing the movement of the locking slide between locked and unlocked positions. Furthermore, the operation of the binding can also be impeded by the penetration of snow and the formation of ice at the interior of the sliding surface.

SUMMARY OF THE INVENTION

The present invention relates to improvements with respect to such a binding with the object of facilitating the sliding of the locking slide to assure excellent impermeability between the locking slide and its sliding surface.

To this end, this front binding for a cross-country ski boot, comprising a locking slide mounted for longitudinal movement, operated by a control device, in a sliding surface fixed to the ski, comprises at least one slide piece between the movable locking slide and the fixed sliding surface, the slide piece being made of synthetic material which has, on its face subjected to friction resulting from relative movement between the locking slide and the sliding surface, transversal projections of relatively flexible material which are deformed in such a way as to always be applied with a certain pressure against the face on which they slide plastically or elastically during the longitudinal movement of the locking slide.

BRIEF DESCRIPTION OF THE DRAWINGS

Several embodiments of the invention will now be described with reference to the attached drawings, in which.

DESCRIPTION OF PREFERRED EMBODIMENTS

Figure 1:
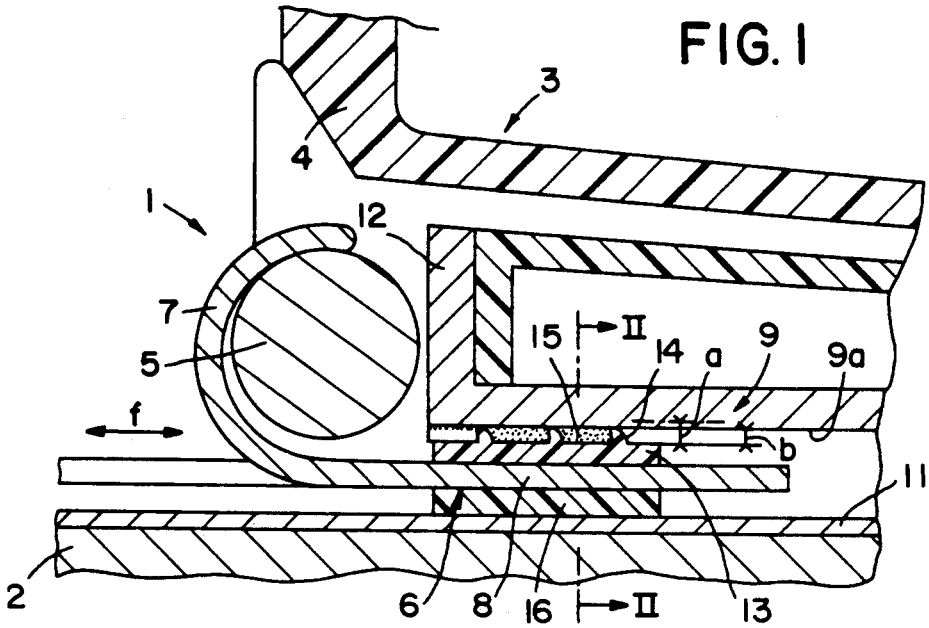
FIG. 1 is a partial, vertical and longitudinal section view of a front binding for a cross-country ski boot according to the invention, in locking position.
Figure 3:
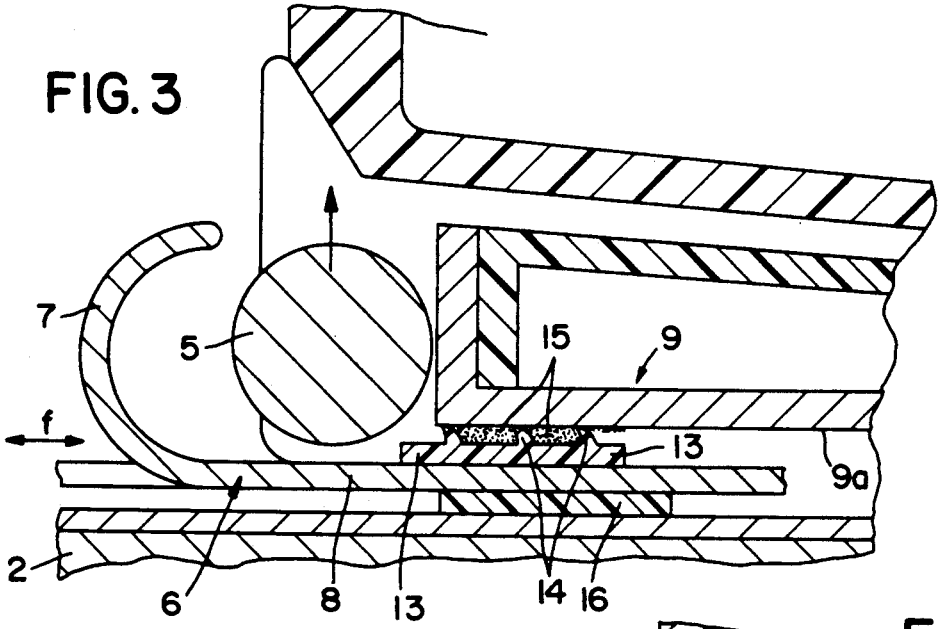
FIG. 3 is a vertical and longitudinal section view of the front binding of FIG. 1, in unlocked position.

FIG. 1 shows a binding 1 for retaining on a cross-country ski 2 the front of a boot 3 whose sole 4 is provided, at its front end, with a transversal hooking axle 5 extending close to the lower face of the sole 4. The front binding 1 comprises, in the conventional fashion, a casing on which is articulated a control lever or similar device which causes longitudinal movement of a locking slide 6. For the sake of clarity, the upper portion of binding 1 and its control lever have not been shown in the drawings. The means which assure the longitudinal displacement of the locking slide 6 in both directions are simply indicated by the double arrow f in the drawing.

The locking slide 6, constituted by a cambered and cut out metal piece, comprises, at its front end, a hook 7 which extends transversely and which, in this first embodiment, is open toward the rear. This hook 7 is extended towards the back by a web 8 which is engaged in a longitudinal slide 9 attached to a base plate 11, itself attached to the upper face of the ski 2, this slide 9 and base plate 11 being constituted by cut out and cambered metal pieces.

The web 8 of the slide 6 can thus slide longitudinally while being closely guided between the upper slide 9 and the lower base plate 11. Slide 9 is solid, at its front end, with a frontal wing 12 which extends transversely and vertically towards the top. This wing 12 constitutes a frontal abutment for the hooking axle 5, of the boot 3, which, in the locking position shown in FIG. 1, is captive between the hook 7, then in its extreme rear position, and the frontal abutment 12. In the unlocking position shown in FIG. 2, hook 7 is offset towards the front so that sufficient space is provided between the end of its upper portion and frontal abutment 12 to allow axle 5 to escape upwardly, thus freeing the boot from the binding.

Figure 2:
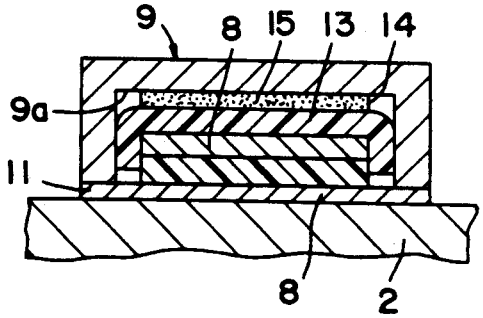
FIG. 2 is a section view along line II—II of FIG. 1.

To improve the sliding of locking slide 6 at the interior of slide 9, by reducing the forces of friction, web 8 of slide 6 is made solid with a sliding piece 13 of synthetic material which is inserted between the upper face of the web 8 of locking slide 6, to which it is fixed, and the lower face **9*a* of the upper, horizontal wall of slide 9. This sliding piece 13 may be constituted by a flat plate, or it may comprise a vertical and transversal section in the form of an inverted U, as shown in FIG. 2, so as to closely surround the upper face of web 8 of the locking slide 6** and its two lateral faces.

The upper face sliding piece 13 is provided with transversal projections 14 of relatively flexible material, which are deformed plastically or elastically, in such a way as to always be applied with a certain pressure against the lower face 9a of the upper wall of slide 9. To this end, the projections 14, which may be constituted by transverse ribs having, for example, a cross-section in the form of an isosceles triangle having its apex at the top have, in the unstressed condition shown in chain-dotted lines in FIG. 1, a height which is a slightly greater than the distance b between the upper face of sliding piece 13 and the lower face 9a of the upper wall of slide 9. As a result, the relatively flexible projections 14 of sliding piece 13 are slightly flattened when web 8 of locking slide 6 is introduced in the slide 9, and they rub against the lower face 9a of the upper wall of slide 9. They hence assure perfect leak-tightness as well as compensation for manufacturing tolerances, so that less precise dimensioning of the constituent element becomes possible.

The spaces delimited between the projections 14 can be used for reserves of grease 15 contributing to the lubrication of the lower face 9a of the upper wall of the slid 9 and thus to facilitate the sliding by a reduction of friction.

Figure 4:
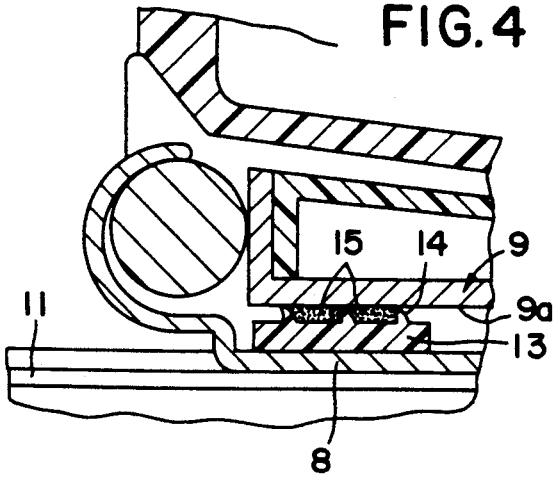
FIG. 4 is a partial vertical and longitudinal section view of a second embodiment of a front binding according to the invention.

At its lower part, the locking slide 6 can slide on another sliding piece 16, of synthetic material, which may be constituted by a flat plate fixed to the base plate 11 when the latter is made of metal, in order to reduce friction between the lower face of slide 6 and the base plate 11 which constitutes the lower wall of slide 9. If base plate 11 is made of synthetic material, the fixed sliding piece 16 can be omitted, as shown in FIG. 4.

The lower sliding piece 16 may be made in the same way as the upper sliding piece 13, i.e., by being provided, on its upper face, with projections applied against the lower face of locking slide 6 with reserves of grease between the projections assuring lubrication of the lower face of locking slide 6. Lower sliding piece 16 may also have a U-shaped vertical and transversal section closely surrounding the lower face of web 8 of locking slide 6 and its two lateral faces. In this case, the upper sliding piece 13 is constituted by a flat plate extending to the interior of the U formed by the lower sliding piece 16, or to the top of the upper ends of the two lateral and vertical wings of the lower U-shaped sliding piece 16.

While in the above-described embodiment of the front binding locking slide 6 carries a hook 7 open toward the rear and cooperating with a frontal abutment 12 located behind this hook, it will be clear that the invention can also be applied to bindings in which the hook of the locking slide is open toward the front and cooperates with a frontal abutment located forwardly of this hook, or to any other type of binding comprising an element sliding on a sliding surface.

We claim:

1. A front binding for a cross-country ski boot (3), comprising a locking slide (6) mounted for longitudinal movement in a slide (9, 11) fixed to a ski, said binding comprising, between said locking slide (6) and at least one sliding surface (9a, 11) of said slide (9, 11), a sliding piece (13) of synthetic material, said sliding piece having, on a face thereof subjected to friction resulting from relative movement between said locking slide (6) and said at least one sliding surface (9a, 11), at least one transverse projection (14) of relatively flexible material, said at least one projection being deformed in such a way as to always be applied with a predetermined pressure against a sliding surface on which said at least one projection slides during longitudinal movement of said locking slide (6).

2. A binding according to claim 1, wherein said at least one projection (14) is constituted by a transverse rib.

3. A binding according to claim 1, wherein said at least one projection (14), when not deformed, has a height (a) slightly greater than the distance (b) between the face of the sliding piece (13) from which it projects and the face (9a) on which it slides.

4. A binding according to claim 1, comprising a plurality of transverse projections (14), reserves of grease (15) being stored in spaces delimited between said projections (14).

5. A binding according to claim 1, wherein the sliding piece (13) is inserted between an upper face of the locking slide (6) and a lower face of said slide (9).

6. A binding according to claim 5, wherein the sliding piece (13) is fixed to the upper face of the locking slide (6) and the projections (14) rub against the lower face of the upper wall of the slide (9).

7. A binding according to claim 6, wherein the sliding piece (13) has a U-shaped vertical and transverse section, and closely surrounds the upper face and two lateral faces of the locking slide.

8. A binding according to claim 1, wherein a lower sliding piece (16) is inserted between the lower face of the locking slide (6) and one of the upper face of a base plate (11) and the lower wall of the slide (9).

* * * * *